US006803707B2

(12) United States Patent
Ishiwata et al.

(10) Patent No.: US 6,803,707 B2
(45) Date of Patent: Oct. 12, 2004

(54) ELECTRON SOURCE HAVING AN INSULATING LAYER WITH METAL OXIDE PARTICLES

(75) Inventors: Kazuya Ishiwata, Kanagawa (JP); Shuji Yamada, Kanagawa (JP); Tadayasu Meguro, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 128 days.

(21) Appl. No.: 09/846,364

(22) Filed: May 2, 2001

(65) Prior Publication Data

US 2002/0008454 A1 Jan. 24, 2002

(30) Foreign Application Priority Data

May 8, 2000 (JP) ..... 2000/134825

(51) Int. Cl.[7] ..... H01J 1/304; H01J 1/62
(52) U.S. Cl. ..... 313/310; 313/496
(58) Field of Search ..... 313/309, 310, 313/351, 495, 496, 497, 336; 315/169.3; 345/74

(56) References Cited

U.S. PATENT DOCUMENTS

| | | | | |
|---|---|---|---|---|
| 4,954,744 A | | 9/1990 | Suzuki et al. | 313/336 |
| 5,286,503 A | | 2/1994 | Kupcikevicius | 426/110 |
| 5,532,544 A | * | 7/1996 | Yoshioka et al. | 313/310 |
| 5,756,207 A | * | 5/1998 | Clough et al. | 428/375 |
| 5,872,541 A | * | 2/1999 | Yoshioka et al. | 345/74.1 |
| 6,208,071 B1 | | 3/2001 | Nishimura et al. | |
| 6,268,229 B1 | * | 7/2001 | Brandes et al. | 144/134.1 |

FOREIGN PATENT DOCUMENTS

| | | |
|---|---|---|
| EP | 0850892 A | 7/1998 |
| EP | 1 003 197 A2 | 5/2000 |
| JP | 1-279538 | 11/1989 |
| JP | 1-279540 | 11/1989 |
| JP | 2630983 | 11/1989 |
| JP | 1-298624 | 12/1989 |
| JP | 2630988 | 12/1989 |
| JP | 2646326 | 8/1997 |
| JP | 10-241550 | 9/1998 |
| JP | 2000-82384 | 3/2000 |
| JP | 3135118 | 8/2000 |
| JP | 2000-243225 | 9/2000 |

OTHER PUBLICATIONS

W.P. Dyke, Advances in Electronics and Electron Physics, 8, 89 (1956); Field Emission.

(List continued on next page.)

*Primary Examiner*—Nimeshkumar D. Patel
*Assistant Examiner*—Karabi Guharay
(74) *Attorney, Agent, or Firm*—Fitzpatrick, Cella, Harper & Scinto

(57) ABSTRACT

Disclosed is an electron source forming substrate provided with an insulating material layer provided on the surface of a substrate, at which surface an electron-emitting device is disposed, wherein the insulating material layer has a plurality of partially exposed metal oxide particles on its surface. Also disclosed are an electron source including a substrate and an electron-emitting device arranged on the substrate, wherein the substrate is an electron source forming substrate as described above, and an image display apparatus including an envelope, an electron-emitting device arranged in the envelope, and an image display member adapted to display images through application of electrons from the electron-emitting device, wherein a substrate on which the electron-emitting device is arranged is an electron source forming substrate as described above.

18 Claims, 12 Drawing Sheets

OTHER PUBLICATIONS

C.A. Spindt, Journal of Applied Physics, 47, 5248 (1976); Physical properties of thin–film field emission cathodes with molybdenum cones.

M.I. Elinson, Radio Engineering Electron Physics, 10, 1290 (1965); The Emission of Hot Electrons and the Field Emission of Electrons from Tin Oxide.

G. Dittmer, Thin Solid Films, 9, 317 (1972); Electrical Conduction and Electron Emission of Discontinuous Thin Films.

M. Hartwell, IEEE Transactions Electron Devices Conference, 519 (1975); Strong Electron Emission from Patterned Tin–Indium Oxide Thin Films.

H. Araki, Journal of the Vacuum Society of Japan, vol. 26, No. 1, p. 22 (1983); Electroforming and Electron Emission of Carbon Thin Films. Abstract.

* cited by examiner

ELECTRON SOURCE HAVING AN INSULATING LAYER WITH METAL OXIDE PARTICLES

BACKGROUND OF THE INVENTION

1. Field of the Invention

The present invention relates to an electron source forming substrate, an electron source using the substrate, and an image display apparatus.

2. Related Background Art

Conventionally known electron-emitting devices are roughly divided into two types: thermal electron-emitting devices and cold-cathode electron-emitting devices. Examples of the cold-cathode electron-emitting devices include field emission type devices (hereinafter referred to as "FE-type" devices), metal/insulating-layer/metal-type devices (hereinafter referred to as "MIM-type" devices), and surface conduction electron-emitting devices.

Known examples of the FE-type devices are disclosed in W. P. Dyke & W. W. Dolan, "Field emission, Advance in Electron Physics, 8, 89 (1956)", C. A. Spindt, "Physical Properties of Thin-Film Field Emission Cathodes with Molybdenium Cones", J. Appl. Phys., 47, 5248 (1976), etc.

Examples of the surface conduction electron-emitting device are disclosed in M. I. Elinson, Recio Eng. Electron Phys., 10, 1290 (1965), etc.

A surface conduction electron-emitting device utilizes a phenomenon in which electron emission occurs by causing an electric current to flow through a small-area thin film formed on a substrate in parallel with the film surface. Reported examples of the surface conduction electron-emitting device include one using an $SnO_2$thin film according to Elinson et al., one using an Au thin film [G. Dittmer: "Thin Solid Films", 9, 317 (1972)], one using an $In_2O_3$/$SnO_2$thin film [M. Hartwell and C. G. Fonstad: "IEEE Trans. ED Conf." 519(1975)], and one using a carbon thin film [Hisashi Araki, et al.: "Vacuum", Vol. 26, No. 1, page 22 (1983)].

To utilize an electron source, formed by arranging an electron-emitting device as mentioned above on a substrate, while holding it in an envelope in which a vacuum is maintained, it is necessary to join the electron source, the envelope and the other members to each other. This joining is generally effected through heating and fusion using frit glass. The typical heating temperature at this time is approximately 400 to 500° C., and the typical heating time, which depends upon the size of the envelope, etc., is approximately 10 minutes to one hour.

It is desirable to use soda lime glass as the material of the envelope since it easily allows joint by frit glass and it is relatively inexpensive. A high strain point glass, in which Na is partly replaced with K to achieve a high strain point, is also preferable since it easily allows frit connection. Regarding the material of the substrate of the electron source, soda lime glass or high strain point glass is also preferable from the viewpoint of reliable joint with the envelope.

Soda lime glass contains a large amount of alkali metal, in particular, Na, which is in the form of $Na_2O$. Na is subject to diffusion due to heat, so that when it is exposed to high temperature during processing, Na is diffused into various components formed on the soda lime glass, in particular, into the component constituting the electron-emitting device, thereby deteriorating its characteristics.

When a high strain point glass, described above, is used as the substrate of an electron source, the above-mentioned Na diffusion is mitigated since the Na content is small. However, it was found that Na diffusion also occurs in this case.

As a means for reducing the influence of Na, Japanese Patent Application Laid-Open No. 10-241550 and EP-A-850892 disclose an electron source forming substrate in which the Na concentration at least in the surface region on the side where the electron-emitting device is arranged is smaller as compared with that in the other regions, and an electron source forming substrate which includes a phosphorus containing layer.

However, it should be noted that an electron source forming substrate is usually formed of an insulating material, so that when driving is effected in a state in which a high voltage for causing electron emission is being applied, a charge-up phenomenon due to secondary electrons, etc. occurs in the exposed portion of the substrate. When nothing is done to cope with this charge-up phenomenon, it is difficult to perform driving in a stable manner for a long period of time, and the orbit of the electrons emitted from the electron source is disturbed, with the result that the electron emission characteristics undergo change with passage of time.

As an example of a means for reducing the influence of the charge-up phenomenon, U.S. Pat. No. 4,954,744 and Japanese Patent Application Laid-Open No. 8-180801 disclose a construction in which the substrate surface or the electron-emitting device surface are covered with an anti-static layer having a sheet resistance of $10^8$ to $10^{10}$ Ω/□.

SUMMARY OF THE INVENTION

It is an object of the present invention to provide an electron source forming substrate in which the change with passage of time of the electron emitting property of the electron-emitting device is reduced or in which it is possible to prevent charge-up from occurring on the substrate surface. Further, the present invention aims to provide an electron source and an image display apparatus using such a substrate.

In accordance with the present invention, there is provided an electron source forming substrate provided with an insulating material layer on a surface of a substrate, at which surface an electron-emitting device is disposed, wherein the insulating material layer has a plurality of partially exposed metal oxide particles on its surface.

In accordance with the present invention, there is further provided an electron source forming substrate provided with an insulating material layer on a surface of a substrate, at which surface an electron-emitting device is disposed, wherein the insulating material layer has a plurality of partially exposed metal oxide particles on its surface and a plurality of enclosed metal oxide particles.

In accordance with the present invention, there is further provided an electron source forming substrate provided with an $SiO_2$ layer on a surface of the substrate, at which surface an electron-emitting device is disposed, wherein the $SiO_2$ layer has a plurality of partially exposed metal oxide particles on its surface.

In accordance with the present invention, there is further provided an electron source forming substrate provided with an $SiO_2$ layer on a surface of a substrate, at which surface an electron-emitting device is disposed, wherein the $SiO_2$ layer has a plurality of partially exposed metal oxide particles on its surface, and a plurality of enclosed metal oxide particles.

In accordance with the present invention, there is further provided an electron source comprising a substrate and an electron-emitting device arranged on the substrate, wherein the substrate is one of the above-described electron source forming substrates.

In accordance with the present invention, there is further provided an image display apparatus comprising an envelope, an electron-emitting device arranged in the envelope, and an image display member adapted to display images through application of electrons from the electron-emitting device, wherein the substrate on which the electron-emitting device is arranged is one of the above-described electron source forming substrates.

BRIEF DESCRIPTION OF THE DRAWINGS

FIGS. 2A and 2B are schematic diagrams showing an example of the electron source of the present invention, of which FIG. 2A is a plan view and FIG. 2B is a sectional view;

FIGS. 3A and 3B are enlarged schematic partial views of an example of a surface conduction electron-emitting device applicable to the electron source of the present invention, of which FIG. 3A is a plan view and FIG. 3B is a sectional view;

FIGS. 4A and 4B are enlarged schematic partial views of another example of a surface conduction electron-emitting device applicable to the electron source of the present invention, of which FIG. 4A is a plan view and FIG. 4B is a sectional view;

DETAILED DESCRIPTION OF THE PREFERRED EMBODIMENTS

Figure 1A:
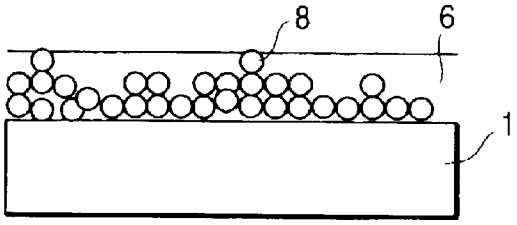
FIGS. 1A and 1B are schematic sectional views showing an example of the electron source forming substrate of the present invention.

In accordance with the present invention, there is provided an electron source forming substrate which has an insulating material layer on the surface thereof on which an electron-emitting device is arranged, wherein the insulating material layer has a plurality of partially exposed metal oxide particles on its surface.

Further, in accordance with the present invention, there is provided an electron source forming substrate which has an insulating material layer on the surface thereof on which an electron-emitting device is arranged, wherein the insulating material layer has a plurality of partially exposed metal oxide particles on its surface, and a plurality of enclosed metal oxide particles.

More preferably, the electron source forming substrate of the present invention has the following features.

In the insulating material layer, the plurality of enclosed metal oxide particles form a metal oxide particle layer between the substrate surface and the surface of the insulating material layer.

In the insulating material layer, the plurality of enclosed metal oxide particles and the plurality of partially exposed metal oxide particles form a metal oxide particle layer between the substrate surface and the surface of the insulating material layer.

The average particle size of the plurality of metal oxide particles partially exposed on the surface of the insulating material layer is larger than the average particle size of the plurality of metal oxide particles enclosed in the insulating material layer.

The average particle size of the plurality of metal oxide particles partially exposed on the surface of the insulating material layer ranges from 50 nm to 70 nm, and the average particle size of the metal oxide particles enclosed in the insulating material layer ranges from 6 nm to 40 nm.

The average particle size of the plurality of metal oxide particles partially exposed on the surface of the insulating material layer is 60 nm, and the average particle size of the metal oxide particles enclosed in the insulating material layer ranges from 6 nm to 40 nm.

The substrate is one containing sodium.

The insulating material layer is a sodium blocking layer. The insulating material layer is an antistatic layer.

Further, in accordance with the present invention, there is provided an electron source forming substrate having an $SiO_2$ layer on the surface thereof on which an electron-emitting device is arranged, wherein the $SiO_2$ layer has a plurality of partially exposed metal oxide particles on its surface.

Further, in accordance with the present invention, there is provided an electron source forming substrate having an $SiO_2$ layer on the surface thereof on which an electron-emitting device is arranged, wherein the $SiO_2$ layer has a plurality of partially exposed metal oxide particles on its surface and a plurality of enclosed metal oxide particles.

More preferably, the electron source forming substrate of the present invention has the following features.

In the $SiO_2$ layer, the plurality of enclosed metal oxide particles form a metal oxide particle layer between the substrate surface and the surface of the $SiO_2$ layer.

In the $SiO_2$ layer, the plurality of enclosed metal oxide particles and the plurality of partially exposed metal oxide particles form a metal oxide particle layer between the substrate surface and the surface of the $SiO_2$ layer.

The average particle size of the plurality of metal oxide particles partially exposed on the surface of the $SiO_2$ layer is larger than the average particle size of the plurality of metal oxide particles enclosed in the $SiO_2$ layer.

The average particle size of the plurality of metal oxide particles partially exposed on the surface of the $SiO_2$ layer ranges from 50 nm to 70 nm, and the average particle size of the plurality of metal oxide particles enclosed in the $SiO_2$ layer ranges from 6 nm to 40 nm.

The average particle size of the plurality of metal oxide particles partially exposed on the surface of the $SiO_2$ layer is 60 nm, and the average particle size of the plurality of metal oxide particles enclosed in the $SiO_2$ layer ranges from 6 nm to 40 nm.

The substrate is one containing sodium.

The $SiO_2$ layer is a sodium blocking layer.

The $SiO_2$ layer is an antistatic layer.

More preferably, the electron source forming substrate of the present invention has the following features.

The metal oxide particles are electron conductive oxide particles.

The metal oxide particles are particles of an oxide of a metal selected from Fe, Ni, Cu, Pd, Ir, In, Sn, Sb, and Re.

The metal oxide particles are $SiO_2$ particles.

Further, in accordance with the present invention, there is further provided an electron source comprising a substrate, and an electron-emitting device arranged on the substrate, wherein the substrate is an electron source forming substrate according to the present invention as described above.

More preferably, the electron source of the present invention has the following features.

The electron-emitting device is an electron-emitting device provided with an electroconductive film including an electron-emitting region.

A plurality of said electron-emitting devices are connected by matrix wiring through a plurality of row-directional wirings and a plurality of column-directional wirings.

Further, in accordance with the present invention, there is provided an image display apparatus comprising an envelope, an electron-emitting device arranged in the envelope, and an image display member for displaying an image through electron application from the electron-emitting device, wherein the substrate on which the electron-emitting device is arranged is an electron source forming substrate according to the present invention described above.

More preferably, the image display apparatus of the present invention has the following features.

The electron-emitting device is one provided with an electroconductive film including an electron-emitting region.

A plurality of said electron-emitting devices are connected by a matrix wiring through a plurality of row-directional wirings and a plurality of column-directional wirings.

A study conducted by the present inventors has revealed that a great variation in characteristics occurs depending upon the condition of the metal oxide particles in the insulating material layer formed on the substrate and containing metal oxide particles, and that an optimum particle condition allows the effect of the present invention to be fully realized.

In the electron source forming substrate of the present invention, due to the provision of an insulating material layer having a plurality of partially exposed metal oxide particles on the surface of the substrate where the electron-emitting device is arranged, and more specifically, due to the provision, for example, of an $SiO_2$ layer containing $SiO_2$ particles, it is possible to effectively block the Na of an Na containing substrate, in particular, the Na of a glass substrate containing as main components 50 to 75% by weight of $SiO_2$ and 2 to 17% by weight of Na.

In the present invention, the exposure of the metal oxide particles on the surface provides the following advantage.

Due to the exposure of the metal oxide particles on the surface, it is possible to prevent diffusion of Na. At the same time, it is possible to allow more charged-up electrons to escape than in the case of a substrate having a very thin insulating layer, thereby reducing the influence of charging up on the electron emission. However, when the density of the particles exposed on the surface is high, the electroconductivity becomes excessively high, which leads to crosstalk at the time of driving and defective formation of the electron-emitting region. Thus, it is necessary for the metal oxide particles to be exposed on the surface in a dispersed state. In particular, in the case of a surface conduction electron-emitting device, the "dispersed state" is preferably a state in which there is one or less particle in every 10 $\mu$m □ and in which there is one or more particles in every 20 $\mu$m□. The protruding height is preferably 0.05 $\mu$m or less. It should be noted that the density and the height also depend on the configuration of the electron-emitting region, and as such they may not be generalized.

It is to be noted, by using electron conductive oxide particles in particular as the metal oxide particles, it is possible to obtain a more stable electron emission property. In the present invention, the term "electron conductivity" is used as opposed to "ion conductivity". The provision of a layer containing an electron conductive material provides the following advantage.

That is, by providing a layer containing an electron conductive material on the substrate, the substrate surface exhibits electrical conductivity, making it possible to restrain the unstableness during driving due to charge-up. When an ion conductive material is used in order to achieve this electrical conductivity, ions are allowed to migrate as a voltage for driving is continued to be applied for a long period of time, with the result that ion segregation occurs, thereby making the electron source property unstable. It is to be assumed that this is attributable to the fact that due to the large amount of time required for ion migration, the ion migration is not completely restored between pulses, that is, during rest periods when, for example, the voltage for driving is applied in a pulse-like fashion. This ion segregation affects the electron source property. Thus, when, in particular, the substrate has a layer containing an electron conductive material, and the conductivity is mainly based on electron conductivity, little or no ion segregation occurs, making it possible to prevent the above influence on the electron source property.

It is particularly desirable to use $SnO_2$ particles as the metal oxide particles. $SnO_2$ is commercially available and relatively inexpensive, and a fine particle dispersion technique for it has been substantially established. Thus, it can be readily used in the solution for film-forming application.

Preferred embodiments of the present invention will now be described with reference to the drawings.

Figure 1B:
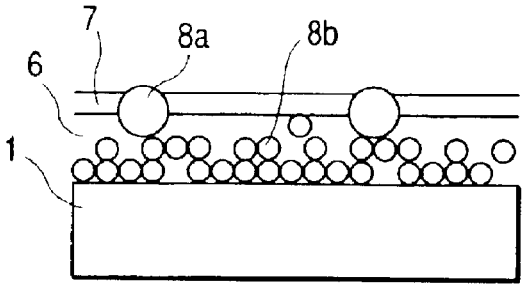

FIGS. 1A and 1B are sectional views showing an embodiment of the electron source forming substrate of the present invention. In FIGS. 1A and 1B, numeral 1 indicates a substrate consisting, for example, of soda lime glass containing Na, or of high strain point glass in which part of Na is replaced with K to raise the strain point. Numeral 6 indicates a first layer containing metal oxide particles, numeral 7 indicates a second layer formed on the first layer, and numerals 8, 8*a*, and 8*b* indicate metal oxide particles.

In the electron source forming substrate of FIG. 1A, formed on the substrate 1 is the first layer 6 having a plurality of partially exposed metal oxide particles 8, and an electron-emitting device is formed on the first layer 6.

In the electron source forming substrate of FIG. 1B, formed on the substrate 1 are the first layer 6 having a plurality of partially exposed metal oxide particles 8*a* and a plurality of enclosed metal oxide particles 8*b*, and the second layer 7 on which an electron-emitting device is formed.

The insulating material layer forming the first layer 6 is preferably a layer whose main component is $SnO_2$and its thickness is preferably not less than 200 nm, and more preferably, not less than 300 nm from the viewpoint of the Na diffusion restraining effect. Further, its thickness is preferably not more than 700 nm from the viewpoint of preventing crack generation or layer separation due to the layer stress.

The average particle size of the metal oxide particles is preferably 6 nm to 70 nm. In the construction as shown in FIG. 1B, it is desirable that the average particle size of the plurality of metal oxide particles 8*a* partially exposed on the surface of the insulating material layer 6 be larger than the average particle size of the plurality of metal oxide particles 8*b* enclosed in the insulating material layer 6. It is desirable that the average particle size of the metal oxide particles 8*a* be in the range of 50 nm to 70 nm, and the average particle size of the metal oxide particles 8*b* in the range of 6 nm to 40 nm.

The metal oxide particles may be particles of an oxide of a metal selected, for example, from Fe, Ni, Cu, Pd, Ir, In, Sn, Sb, and Re. In particular, electron conductive oxide particles such as $SnO_2$ particles are preferable.

The second layer 7 is a layer whose main component is an insulating material, preferably $SnO_2$. This layer is provided for the purpose of improving the flatness of the substrate surface on which an electron-emitting device is formed, and preventing falling off of metal oxide particles in the first layer 6 and Na diffusion. This second layer 7 is formed on the first layer 6 to cover the surface irregularities of the metal oxide particles to thereby improve the flatness of the surface, facilitating the formation of an electron-emitting device. Further, since it is difficult, with the first layer 6 alone, to cause the metal oxide particles to adhere to the substrate in a stable manner, adhesion of the particles is effected by the second layer 7, preventing the metal oxide particles from falling off.

From the viewpoint of improving the flatness, the thickness of the second layer 7 is preferably 40 nm or more. Further, from the viewpoint of an increase in area, the thickness is more preferably 60 nm or more. Further, to prevent crack generation or layer separation due to the layer stress, the thickness is preferably not more than 600 nm.

In the electron source forming substrate of the present invention, the provision of a plurality of metal oxide particles partially exposed on the surface of the insulating material layer helps to prevent charging up of the surface. The insulating material layer 6 constituting the first layer, and the layer preferably used as the second layer and having $SnO_2$as the main component act as insulating layers, and function so as to be an obstruction to electron conductivity, so that a charge removal effect can be obtained by bringing the metal oxide particles of the first layer, preferably, the $SnO_2$particles, to the surface. However, as stated above, exposure of particles in a density not lower than a certain level results in excessive reduction in resistance, involving a problem at the time of driving. Thus, in the present invention, it is desirable to control the density of exposed particles by appropriately adjusting the particle mixing state or causing them to cling together on purpose.

In the case of the construction of FIG. 1A, it is desirable for the metal oxide particles partially exposed from the insulating material layer 6 constituting the first layer to break through the first layer 6 at a ratio of one particle for every 10 to 20 $\mu m\square$. Further, in the case of the construction of FIG. 1B, it is desirable for the metal oxide particles partially exposed through the insulating material layer 6 constituting the first layer to break through the second layer 7. When forming a surface conduction electron-emission device on the electron source forming substrate of the present invention, it is desirable that the height of the particles breaking through the above-mentioned layer be not more than 100 nm, and more preferably, not more than 50 nm. This can be realized by controlling the cohesion state of particles of the same size in forming the first layer, or by mixing particles whose average particle size is not more than 40 nm with particles whose average particle size is approximately 50 to 70 nm when forming the first layer.

Next, an embodiment of the electron source using the above-described electron source forming substrate will be described with reference to FIGS. 2A and 2B.

Figure 2A:
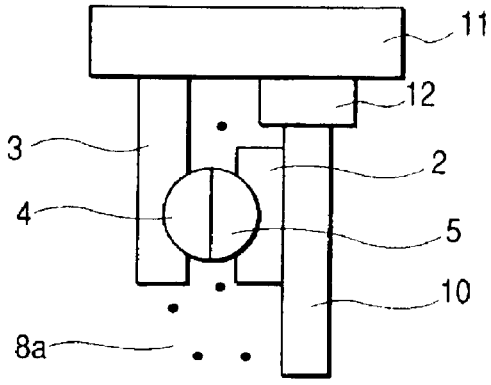
Figure 2B:
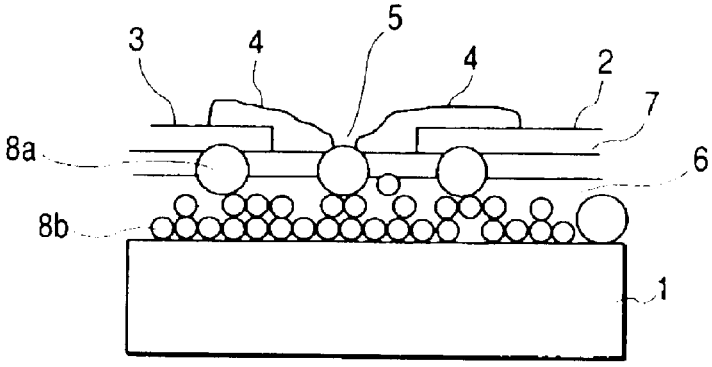

FIGS. 2A and 2B are schematic diagrams showing an embodiment of the electron source of the present invention, of which FIG. 2A is a plan view and FIG. 2B is a sectional view.

The electron source of this embodiment is an electron source formed by using the electron source forming substrate shown in FIG. 1B. In FIGS. 2A and 2B, numerals 1, 6, and 7 respectively indicate a substrate containing Na, a first layer, and a second layer.

In the electron source of this embodiment, an electron-emitting device is formed on the second layer 7. Here, the electron-emitting device is, for example, an electron-emitting device provided with a pair of electrodes, and an electroconductive film arranged between the pair of electrodes and having an electron-emitting region. As shown in FIGS. 2A and 2B, in this embodiment, a surface conduction electron-emitting device is used which is provided with a pair of conductive layers 4 arranged on either side of a gap 5, and a pair of device electrodes 2 and 3 electrically connected to the pair of conductive layers 4, respectively. It is more desirable that the surface conduction electron-emitting device shown in FIGS. 2A and 2B be a device having a carbon layer on the conductive layers 4.

The surface conduction electron-emitting device used in the electron source of this embodiment will now be described in detail.

First, the material of the opposing device electrodes 2 and 3 can be a generally used one. Examples of the material include metals, such as Ni, Cr, Au, Mo, W, Pt, Ti, Al, Cu, and Pd or alloys thereof, print conductors formed of metals, such as Pd, Ag, Au, $RuO_2$, or Pd-Ag or metal oxides and glass or the like, transparent conductors such as $In_2O_3$-$SnO_2$, and semiconductor materials such as polysilicon.

Examples of the material of the conductive layers 4 include metals, such as Pd, Pt, Ru, Ag, Au, Ti, In, Cu, Cr, Fe, Zn, Sn, Ta, and W, and oxides, such as PdO, $SnO_2$, $In_2O_3$, PdO, and $Sb_2O_3$.

To achieve a satisfactory electron emission property, it is desirable that the conductive layers 4 be fine particle layers formed of a plurality of fine particles having a particle size in the range of 1 nm to 20 nm. Further, the thickness of the conductive layers 4 is preferably in the range of 1 nm to 50 nm.

The gap 5 is formed, for example, by forming in the conductive layer, formed astride the device electrodes 2 and 3, a crack by forming processing.

Further, as stated above, it is desirable to form a carbon layer on the conductive layer 4 from the viewpoint of achieving an improvement in electron emission property and a reduction in change with passage of time in electron emission property.

Figure 3A:
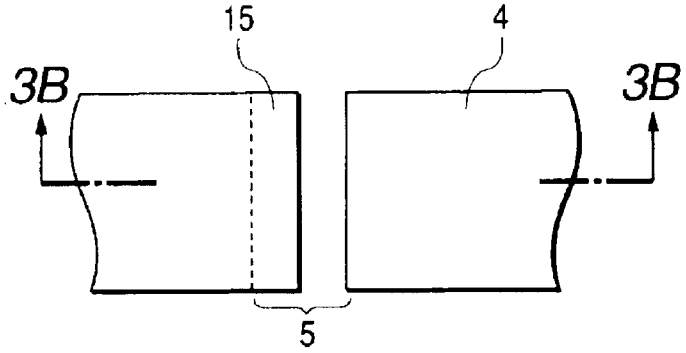
Figure 3B:
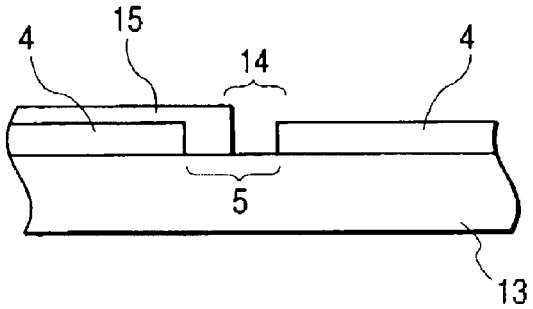

This carbon layer is formed, for example, as shown in FIGS. 3A and 3B. FIG. 3A is an enlarged schematic plan view of the conductive layers of a surface conduction electron-emitting device having a carbon layer, and FIG. 3B is a sectional view thereof taken along the line 3B—3B.

As shown in FIGS. 3A and 3B, the surface conduction electron-emitting device having a carbon layer is connected to the conductive layers 4 so as to form a gap 14 narrower than the gap 5 formed by the pair of conductive layers 4, and has a carbon layer 15 on the substrate 13 in the gap 5 and on the conductive layers 4.

Figure 4A:
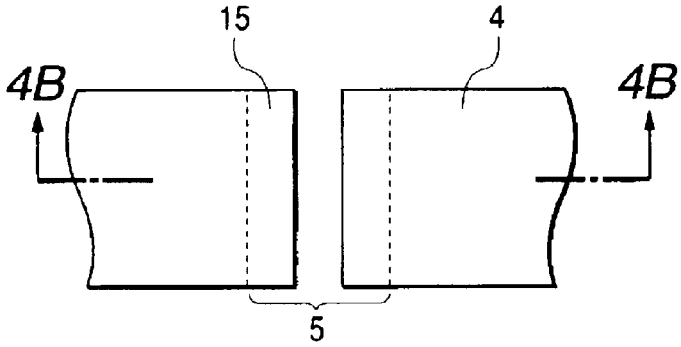
Figure 4B:
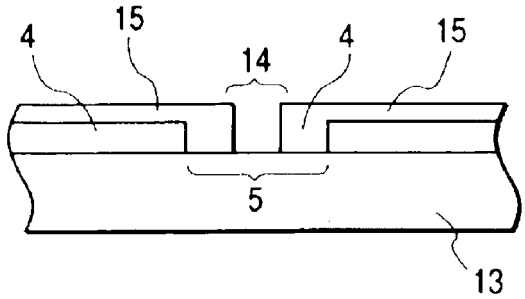

The same effect as that described above can be obtained in a form in which, as shown in FIGS. 4A and 4B, the carbon layer 15 is formed on both end portions of the pair of conductive layers 4 facing the gap 5.

Next, an example of a method for manufacturing the above-described electron source shown in FIGS. 2A and 2B will be described with reference to FIGS. 5A through 5B.

First, a substrate 1 containing Na, such as soda lime glass or high strain point glass, is sufficiently washed in detergent, pure water, organic solvent or the like, and the first layer 6 is formed on the substrate 1. To form the first layer 6, it is desirable to employ a mechanical film formation method, such as spin coating, flexographic printing, or slit coating. In a mechanical film formation method, a compound containing the film forming element is applied by using a spin coater, slit coater, a flexographic printer or the like. Then, a drying process is conducted before baking the organic compound. These methods are advantageous in that the film thickness is relatively uniform.

A mixed type material was used for the first layer in which the main average diameter of the $SnO_2$particles is in the range of 10 to 20 nm, with 5% of particles of a size of 60 nm being added thereto. To effect uniform dispersion of the larger particles and to prevent cohesion of the smaller particles, an agitator was used to disperse the particles in an appropriate manner before performing application as described above. Particles of a fixed average size were allowed to cohere on purpose, and adjustment was effected so as to achieve an average cohesion size of 60 nm and a mixing ratio of approximately 1 to 20% before performing application as described above.

Subsequently, the second layer 7 is formed on the first layer 6. When forming the second layer 7, use of the same mechanical film formation method as that for the first layer 6 is desirable since that allows continuous film formation subsequent to the formation of the first layer 6. For example, a liquid containing an electron conductive oxide is applied by spin coating, and drying is effected. Subsequently, a liquid containing $SiO_2$as the main ingredient is applied before performing baking collectively, whereby the first layer is covered with the second layer. It is to be noted that when forming the second layer, it is necessary to effect control such that the particles of the first layer break through the second layer. For this purpose, it is convenient to form the second layer in a thickness of approximately 60 nm to 200 nm.

Figure 5A:
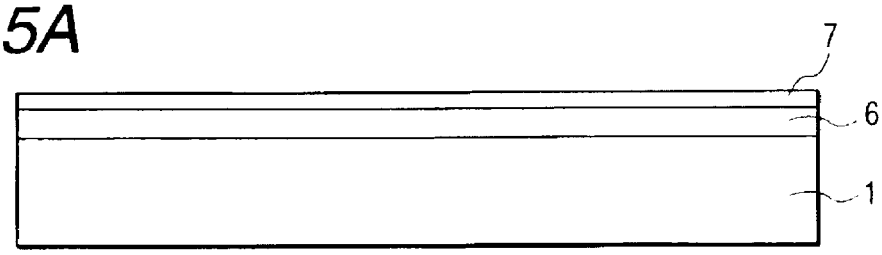
FIGS. 5A, 5B, 5C and 5D are schematic diagrams illustrating procedures for manufacturing an electron source according to the present invention.

In this way, an electron source forming substrate in which the first and second layers 6 and 7 are sequentially formed on the substrate 1 is prepared (FIG. 5A). The sheet resistance of the surface of this substrate was $10^9$ to $10^{11}$ Ω/□.

Next, an electron-emitting device, in particular, a surface conduction electron-emitting device, is formed on the electron source forming substrate.

First, the device electrode material is deposited by vacuum evaporation, sputtering, offset printing or the like. Then, device electrodes 2 and 3 are formed on the surface of the second layer 7 by, for example, photolithography (FIG. 5B).

Next, an organic metal solution is applied to the second layer 7 on which the device electrodes 2 and 3 are provided to form an organic metal thin film. The organic metal solution may be one whose main element is the metal used as the material for the above conductive layers 4. The organic metal thin film is heated and baked, and patterning is performed thereon by lift-off, etching or the like to form the conductive layer 4 (FIG. 5C). While in this example the conductive layer 4 is formed through the application of an organic metal solution, this should not be construed restrictively. It is also possible to employ vacuum evaporation, sputtering, chemical vapor-phase deposition, dispersed application, dipping, spinner method, etc.

Figure 5D:
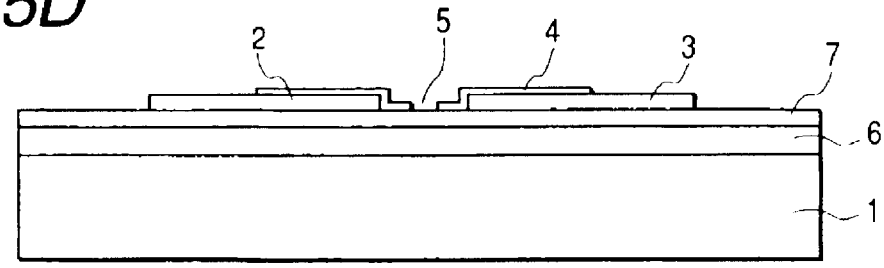
Figure 6A:
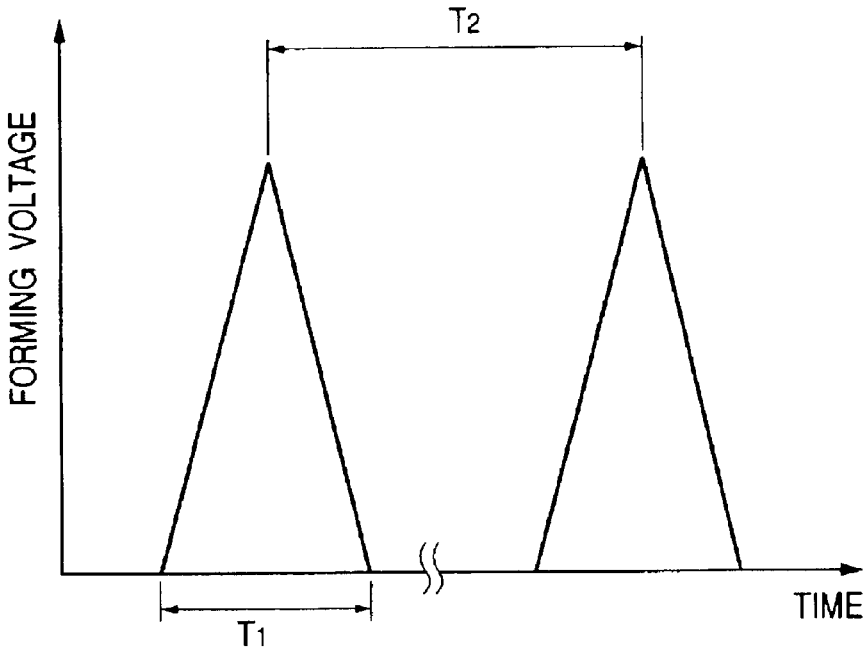
FIGS. 6A and 6B are schematic diagrams showing waveforms of a pulse voltage used in the manufacture of the electron source of the present invention.
Figure 6B:
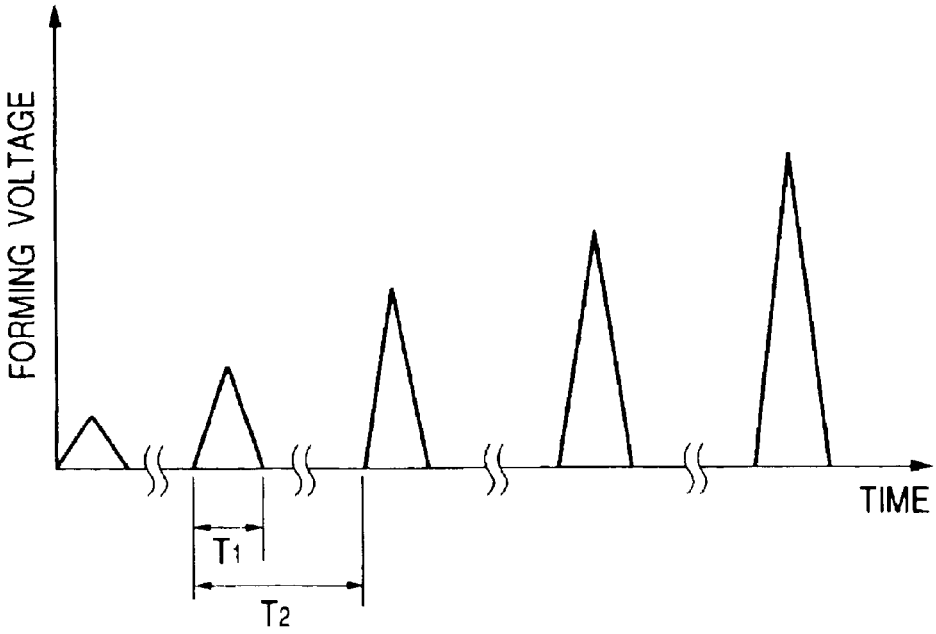

Subsequently, the forming process is performed. As an example of this forming process, an energization processing will be described. When energization is effected between the device electrodes 2 and 3 by using a power source (not shown), a gap 5 is formed in the conductive layer 4 (FIG. 5D). FIGS. 6A and 6B show examples of the voltage waveform in energization forming.

It is desirable for the voltage waveform to be in a pulse waveform. To achieve this, two methods are available: a method in which pulses whose crest value is constant are successively applied, as shown in FIG. 6A; and a method in which voltage pulses are applied while gradually increasing the crest value, as shown in FIG. 6B.

In FIG. 6A, numerals T1 and T2 indicate the pulse width and pulse interval, respectively, of the voltage waveform. Usually, T1 is set in the range of 1 μsec. to 10 msec., and T2 is set in the range of 10 μsec. to 100 msec. The crest value of the triangular pulse (peak voltage in energization forming) is appropriately selected according to the form in which electrons are emitted. In this condition, voltage is applied, for example, for several seconds to several tens of minutes. The pulse waveform is not restricted to a triangular one. It is possible to adopt a desired waveform, e.g., a rectangular wave.

In FIG. 6B, numerals T1 and T2 indicate the same things as in FIG. 6A. In this case, the crest value of the triangular pulse (peak voltage in energization forming) can be increased, for example, 0.1 V per step. When a resistance, for example, of approximately 0.1 V is given in the pulse interval T2, the energization forming process is completed.

It is desirable to perform a processing called activation process on the device which has undergone forming. By performing this processing, the device current If and the emission current Ie vary markedly.

The activation process can be conducted in, for example, an atmosphere containing an organic substance gas, repeating pulse application as in the energization forming. This atmosphere can be created by utilizing an organic gas remaining in an atmosphere after evacuating a vacuum container by, for example, an oil diffusion pump or rotary pump. Alternatively, it can be created by introducing an appropriate organic substance gas into a vacuum obtained by sufficiently evacuating a container by an ion pump or the like. The preferable pressure of the organic substance gas depends upon the application form, the configuration of the vacuum container, the kind of organic substance, etc. Appropriate examples of the organic substance include aliphatic hydrocarbons, such as alkene and alkyne, aromatic hydrocarbons, alcohols, aldehydes, ketones, amines, and organic acids, such as phenol, carboxylic acid, and sulfonic acid. More specifically, it is possible to use saturated hydrocarbons which can be expressed by a formula CnH2n=2, for example, methane, ethane, and propane, unsaturated hydrocarbons which can be expressed by a formula CnH2n, etc., for example, ethylene and propylene, benzene, toluene, methanol, ethanol, formaldehyde, acetaldehyde, acetone, methyl ethyl ketone, methyl amine, ethyl amine, phenol, formic acid, acetic acid, propionic acid, or a mixture of these substances. By this processing, the carbon contained in the organic substance in the atmosphere is deposited on the device in a film, whereby the device current If and the emission current Ie undergo marked variation.

The judgment as to whether the activation process has been completed or not is made appropriately while measuring the device current If and the emission current Ie. The pulse width, pulse interval, pulse crest value, etc. are appropriately set.

The above-mentioned carbon film is, for example, a film of graphite (which contains so-called HOPG, PG, and GC; HOPG has a substantially perfect graphite crystal structure; in PG, the crystal grain size is approximately 20 nm, and the crystal structure is somewhat disturbed; and in GC, the crystal grain size is approximately 2 nm, and the disturbance of the crystal structure is more intense) or amorphous carbon (which means amorphous carbon, or a mixture of amorphous carbon and microcrystal of the above graphite). Its thickness is preferably not more than 50 nm, and more preferably, not more than 30 nm.

In this way, the electron source shown in FIGS. 2A and 2B is produced.

As another embodiment of the electron source formed by using the above-described electron source forming substrate, an electron source in which a plurality of electron-emitting devices are arranged will be described. Further, an example of an image-forming apparatus using such an electron source will be described.

Figure 7:
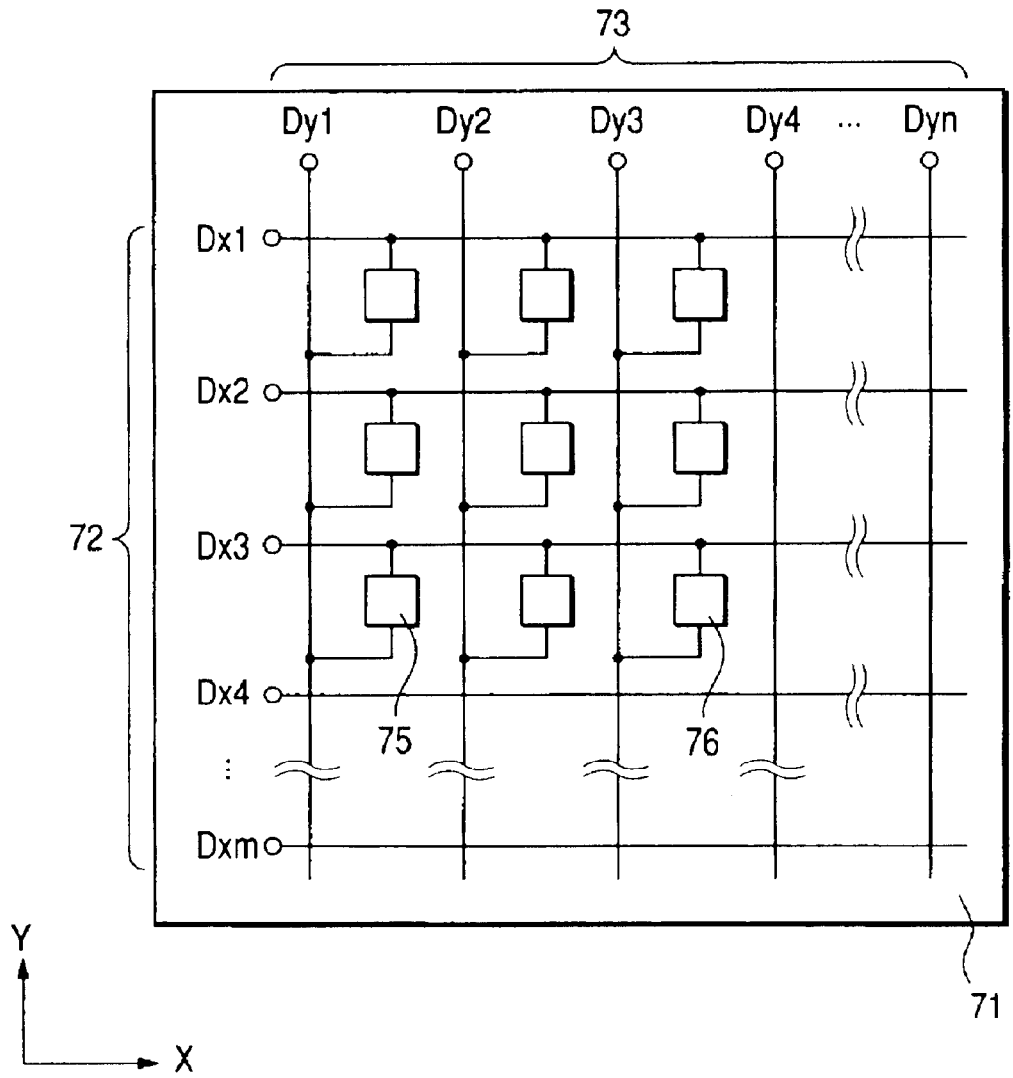
FIG. 7 is a schematic diagram showing a construction example of the electron source of the present invention.

FIG. 7 is a schematic diagram showing an electron source in which a plurality of electron-emitting devices are arranged by matrix wiring on the electron source forming substrate shown in FIGS. 1A and 1B. In FIG. 7, numeral 71 indicates a substrate in which the above-described first and second layers are provided beforehand. Numeral 72 indicates row-directional wirings, and numeral 73 indicates column-directional wirings. Numeral 76 indicates electron-emitting devices, and numeral 75 indicates connections.

The row-directional wirings 72 consist of m wirings, Dx1, Dx2, . . . , Dxm, and can be formed of a conductive metal or the like formed by vacuum evaporation, printing, sputtering or the like. The column-directional wirings 73 consist of n wirings, Dy1, Dy2, . . . , Dyn, and are formed in the same manner as the row-directional wirings 72. Between the m row-directional wirings 72 and the n column-directional wirings 73, there is provided an inter-layer insulating layer (not shown), which electrically separates them from each other (m and n are positive integers).

The inter-layer insulating layer is formed of $SiO_2$ or the like by vacuum evaporation, printing, sputtering or the like. For example, it is formed in a desired configuration on the entire surface or a part of the electron source substrate 71 on which the column-directional wirings 73 are formed. In particular, the film thickness, material, and formation method are appropriately selected so that the electrical potentials at the intersections of the row-directional wirings 72 and the column-directional wirings 73 can be withstood.

The row-directional wirings 72 and the column-directional wirings 73 are led out as external terminals.

The electron-emitting devices 76 are electrically connected to the m row-directional wirings 72 and the n column-directional wirings 73 by the connections 75 consisting of a conductive metal or the like.

Connected to the row-directional wirings 72 is a scanning signal applying means (not shown) for applying a scanning signal for selecting a row of the electron-emitting devices 76 arranged in the X-direction. On the other hand, connected to the column-directional wirings 73 is a modulation signal generating means (not shown) for modulating each column of the electron-emitting devices 76 arranged in the Y-direction in accordance with an input signal. A driving voltage applied to each electron-emitting device is supplied as a voltage corresponding to the difference between the scanning signal and the modulation signal applied to the device.

In the above-described electron source construction, a plurality of surface conduction electron-emitting devices are arranged by means of a simple passive matrix wiring on the above-described electron source forming substrate.

Next, an image-forming apparatus formed by using the above electron source will be described with reference to FIGS. 8, 9A, 9B, and 10.

Figure 8:
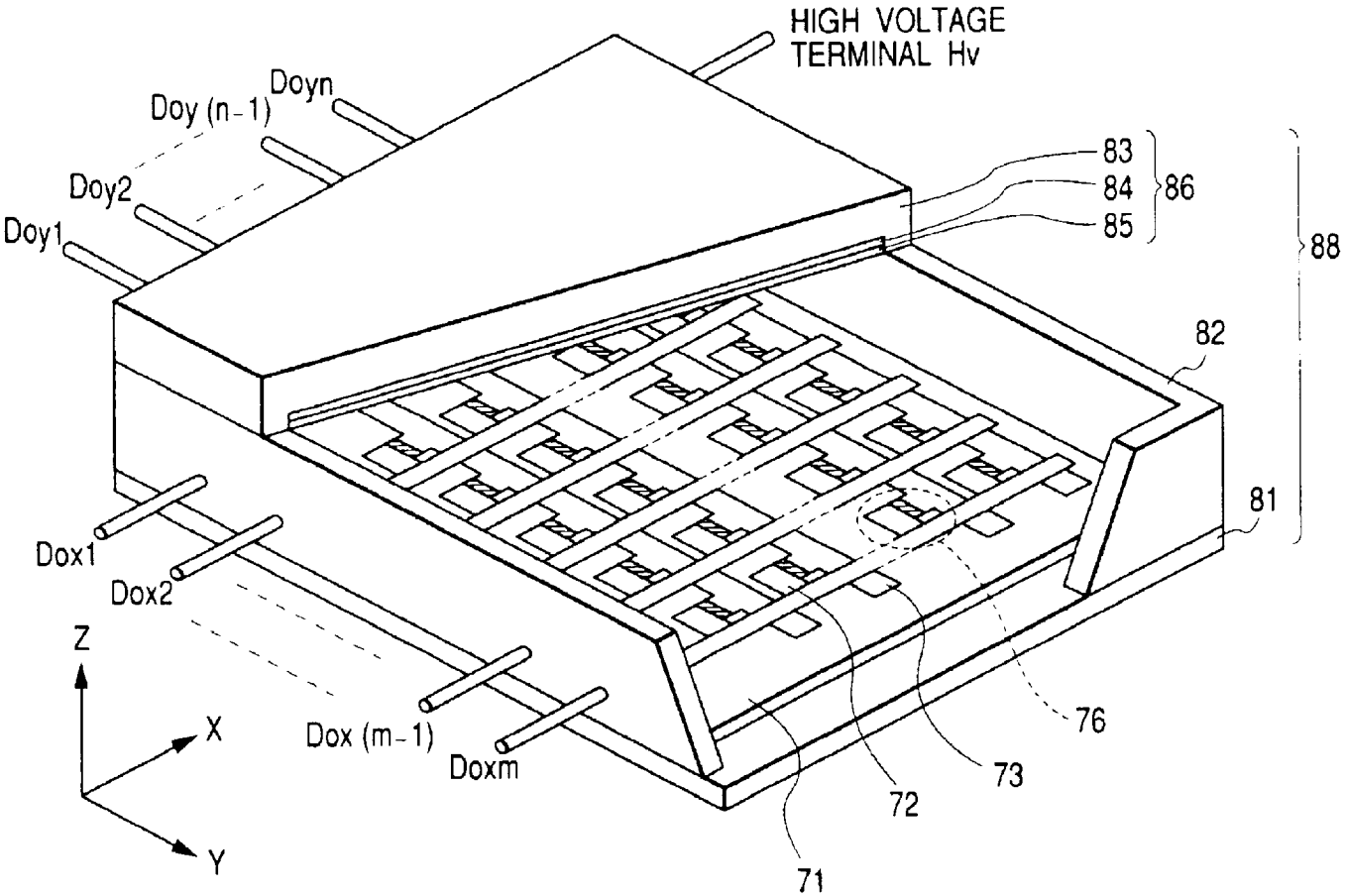
FIG. 8 is a schematic diagram showing a construction example of the image-forming apparatus of the present invention.
Figure 9A:
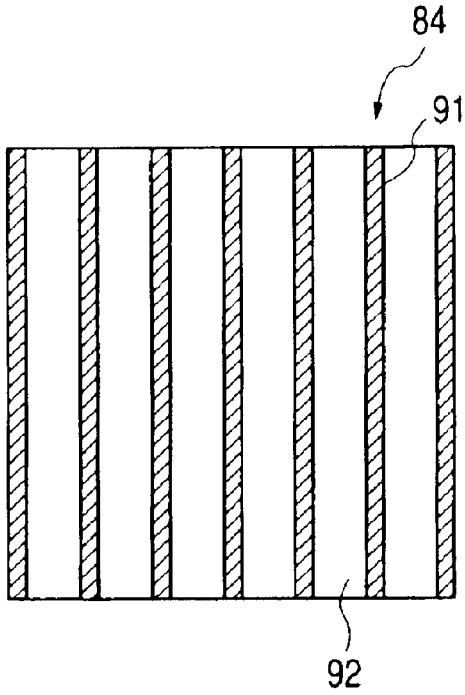
FIGS. 9A and 9B are schematic diagrams showing the construction of a fluorescent layer used in the image-forming apparatus of the present invention.
Figure 9B:
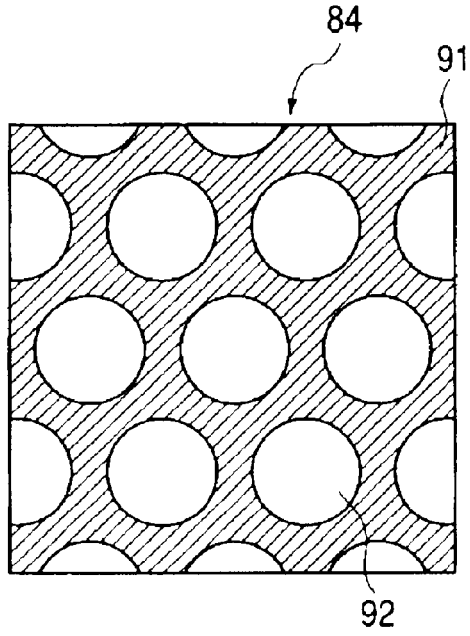
Figure 10:
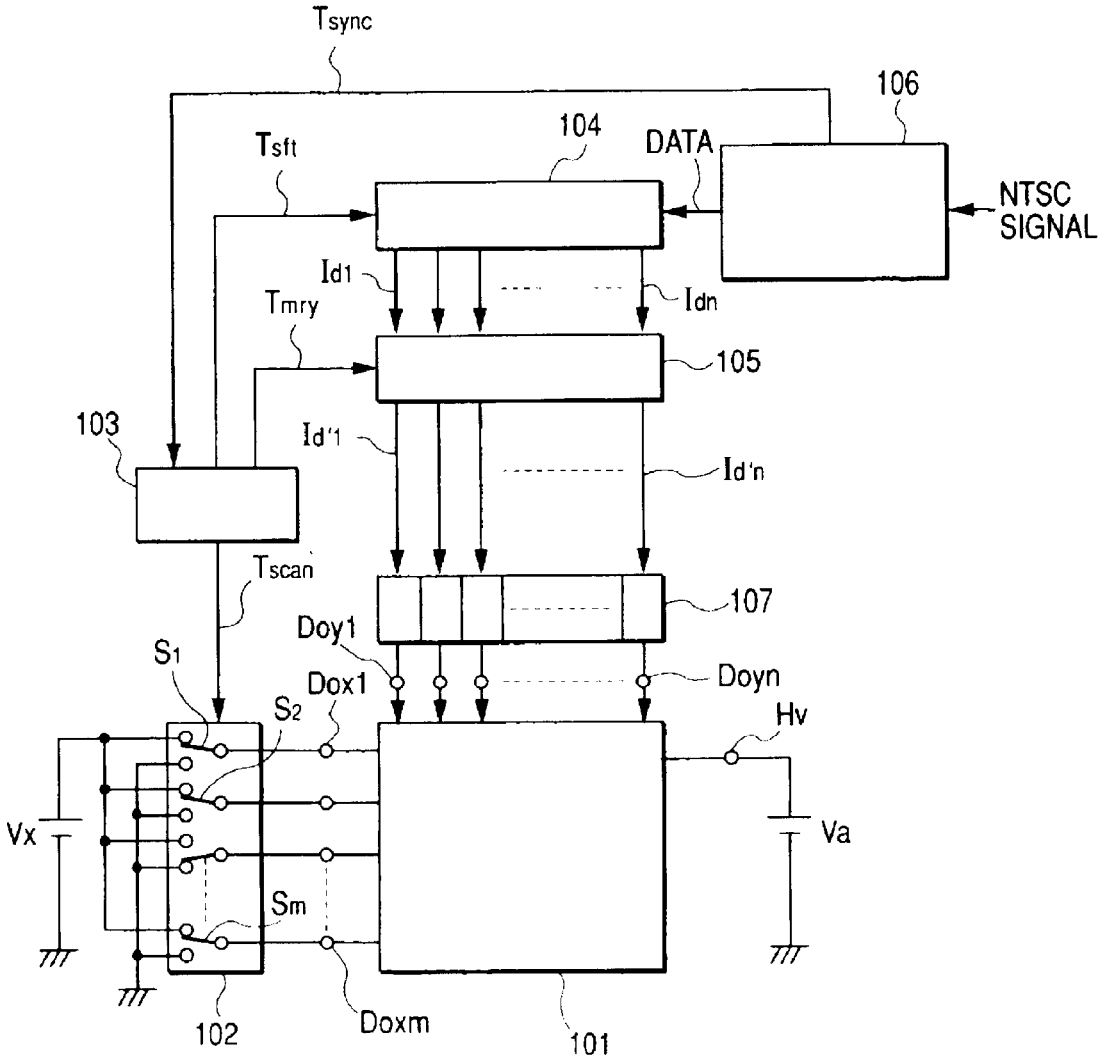
FIG. 10 is a block diagram showing an example of a drive circuit.

FIG. 8 is a schematic diagram showing an example of the display panel of an image-forming apparatus, and FIGS. 9A and 9B are schematic diagrams showing a fluorescent layer used in the image-forming apparatus of FIG. 8. FIG. 10 is a block diagram showing an example of a driving circuit for effecting display in accordance with an NTSC-type television signal.

In FIG. 8, numeral 71 indicates a substrate as described above with reference to FIG. 7 on which a plurality of surface conduction electron-emitting device 76 are arranged. Numeral 81 indicates a rear plate to which the substrate 71 is secured, and numeral 86 indicates a face plate including a glass substrate 83 in which a fluorescent layer 84 and a metal back 85 are formed. Numeral 82 indicates a support frame, to which the rear plate 81 and the face plate 86 are joined by using a low-melting-point frit glass or the like.

Numerals 72 and 73 indicate the row-directional wirings and the column-directional wirings connected to the surface conduction electron-emitting devices 76.

As described above, the envelope 88 is formed by the face plate 86, the support frame 82, and the rear plate 81. The rear plate 81 is provided mainly for the purpose of reinforcing the substrate 71. Thus, when the substrate 71 itself is sufficiently strong, there is no need to provide the rear plate 81. That is, the support frame 82 is directly joined to the substrate 71 by seal bonding, and a support member (not shown) called a spacer is provided between the face plate 86 and the rear plate 81, whereby it is possible to form an envelope 88 having a sufficient strength against the atmospheric pressure.

FIGS. 9A and 9B are schematic diagrams showing a fluorescent layer. In the case of a monochrome type, the fluorescent layer 84 can be formed of phosphor alone. In the case of a color fluorescent layer, it is possible to adopt a phosphor arrangement called a black stripe (FIG. 9A) or a black matrix (FIG. 9B), in which a black conductive material 91 and a phosphor 92 are used. The reason for providing the black stripe or black matrix is to make color mixing or the like less conspicuous by blackening the color-division portions between the phosphors 92 of the requisite three primary colors and to restrain a reduction in contrast due to the external light reflection at the fluorescent layer 84. Usually, the black conductive material 91 consists of a material whose main component is graphite. It is also possible to use a material which is conductive and allows little transmission or reflection of light.

Regardless of whether it is monochrome or colored, the phosphor can be applied to the glass substrate by precipitation, printing, etc.

A metal back 85 is usually provided on the inner side of the fluorescent layer 84. The reason for providing the metal back is to achieve an improvement in luminance through mirror reflection of the inwardly directed light from the phosphor to the face plate 86 side, to cause it to act as an electrode for applying an electron beam acceleration voltage, to protect the phosphor from damage due to collision of negative ions generated in the envelope, etc. The metal back can be prepared by performing surface smoothing (usually called "filming") on the inner side of the fluorescent layer after the preparation thereof and then depositing Al by vacuum evaporation or the like.

To further enhance the conductivity of the fluorescent layer 84, the face plate 86 may have a transparent electrode (not shown) on the outer side of the fluorescent layer 84.

When performing the above-mentioned seal bonding, it is necessary, in the case of a colored fluorescent layer, for the phosphors of the different colors to be in correspondence with the electron-emitting devices. Thus, it is absolutely necessary to perform positioning to a sufficient degree.

An example of the method for manufacturing the image-forming apparatus shown in FIG. 8 will be described.

Figure 11:
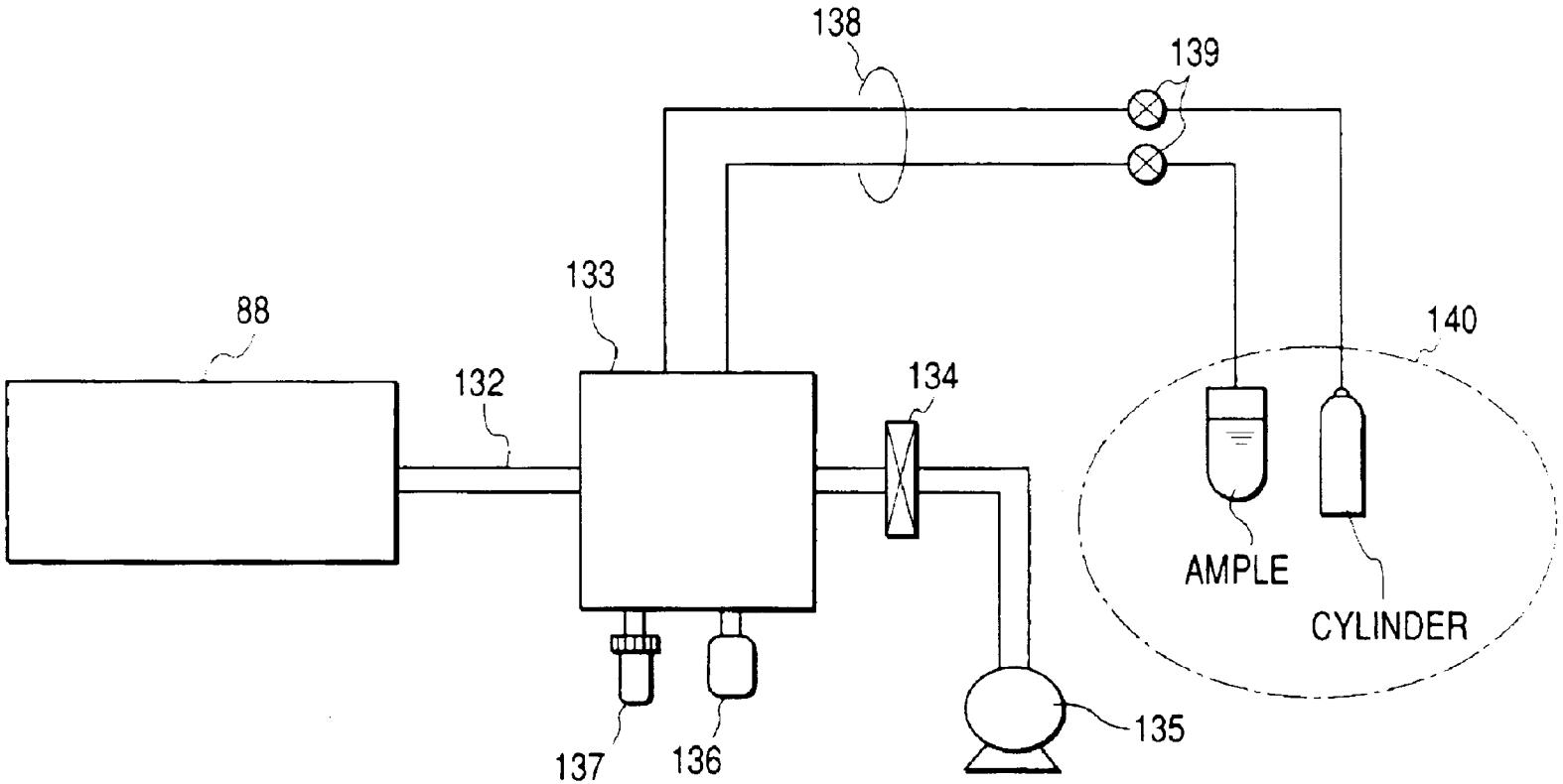
FIG. 11 is a schematic diagram showing the general construction of an apparatus used to produce an image-forming apparatus.

FIG. 11 is a schematic diagram showing an apparatus used for the manufacturing process. The envelope 88 is connected to a vacuum chamber 133 through the intermediation of an exhaust pipe 132, and further connected to an exhaust device 135 via a gate valve 134. To measure the internal pressure and the partial pressure of each of the components of the atmosphere, the vacuum chamber 133 is provided with a pressure gage 136, a quadruple mass spectrograph 137, etc. Since it is difficult to directly measure the pressure, etc. inside the envelope 88, the pressure, etc. inside the vacuum chamber 133 are used instead. Gas introduction lines 138 are connected to the vacuum chamber 133 to further introduce requisite gases into the vacuum chamber to thereby control the atmosphere. Introduction substance sources 140 are connected to the other end of the gas introduction lines 138. The introduction substances are stored in an ample, a cylinder and the like.

Introduction means 139 for controlling the rate at which the introduction substances are introduced are provided at some midpoint of the gas introduction lines 138. Specifically, as the introduction amount control means, it is possible to use a valve like a slow leak valve capable of controlling escape flow rate, a mass flow controller, etc. according to the kind of introduction substance.

Figure 12:
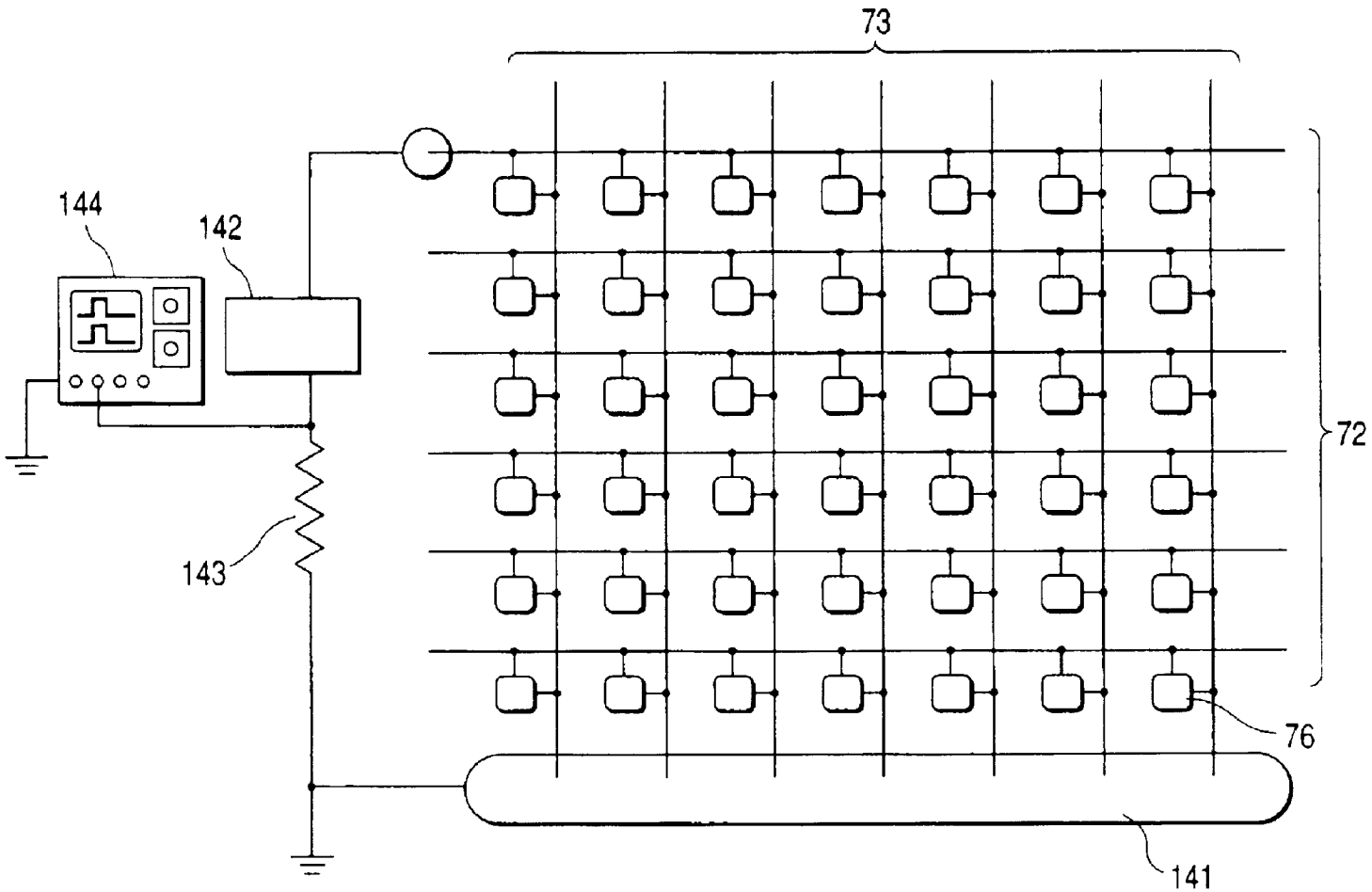
FIG. 12 is a diagram illustrating a connection method for the forming and activation processes for the image-forming apparatus of the present invention.

The interior of the envelope 88 is evacuated by the apparatus of FIG. 11 to perform forming. As shown, for example, in FIG. 12, the column-directional wirings 73 are connected to a common electrode 141, and a voltage pulse is simultaneously applied to a device connected to one of the row-directional wirings 72 by a power source 142, thereby executing forming. Regarding the conditions, such as pulse configuration and processing completion judgment, selection is to be appropriately made in accordance with the above-described method for performing forming on the individual devices. Further, by successively applying (scrolling) pulses which are out of phase to the plurality of row-directional wirings, it is possible to perform forming collectively on the devices connected to the plurality of row-directional wirings. In the drawing, numeral 143 indicates a current measuring resistor, and numeral 144 indicates an oscilloscope for measuring electric current.

After the completion of the forming process, an activation process is conducted. The interior of the envelope 88 is evacuated to a sufficient degree, and then an organic substance is introduced through the gas introduction lines 138. Alternatively, as described above as a method for activating the individual devices, it is possible to execute activation by first effecting evacuation by an oil diffusion pump or a rotary pump and then utilizing the organic substance remaining in the vacuum atmosphere. Further, substances other than an organic substance may be introduced as needed. In the atmosphere containing an organic substance formed in this way, a voltage is applied to each electron-emitting device, whereby carbon or a carbon compound or a mixture of them is deposited on the electron-emitting region to cause a drastic increase in electron emission amount, as in the case of the individual devices. By the same connection as in the case of the above-described forming, a voltage pulse is simultaneously applied to devices connected together in one row direction. Further, by successively applying (scrolling) out-of-phase pulses to a plurality of row-directional wirings, it is possible to collectively activate devices connected to a plurality of row-directional wirings. In this case, it is possible to make the device current uniform for each row-directional wiring.

As in the case of the individual devices, it is desirable to perform a stabilization process after the completion of the activation process.

In this process, the interior of the envelope 88 in which the electron-emitting devices are arranged is evacuated. Specifically, the envelope 88 is heated, and while maintaining it at 80 to 250° C., exhaustion is effected through the exhaust pipe 132 by the exhaust device 135 which is a device using no oil, such as an ion pump or an absorption pump. After an atmosphere containing a sufficiently small amount of organic substance is obtained, the exhaust pipe is heated by a burner to seal it up.

To maintain the pressure of the envelope 88 after the sealing, it is also possible to perform a getter process. In this process, a getter arranged at a predetermined position (not shown) inside the envelope 88 is heated by resistance heating, high-frequency heating or the like immediately before or after the sealing of the envelope 88, thereby forming a seal bonding film. Usually, the main component of the getter is Ba or the like. By the adsorptive activity of the seal bonding film, the atmosphere inside the envelope 88 is maintained.

Next, with reference to FIG. 10, a description will be given of a circuit configuration example of a driving circuit for performing television display based on an NTSC-type television signal through a display panel formed by using an electron source of a passive matrix arrangement. In FIG. 10, numeral 101 indicates an image display panel as shown in FIG. 8, numeral 102 indicates a scanning circuit, numeral 103 indicates a control circuit, and numeral 104 indicates a shift register. Numeral 105 indicates a line memory, numeral 106 indicates a synchronization signal separation circuit, and numeral 107 indicates a modulation signal generator. Symbols Vx and Va indicate DC voltage sources.

The display panel 101 is connected to external electric circuits through terminals Dox1 through Doxm, terminals Doy1 through Doyn, and a high-voltage terminal Hv. Applied to the terminals Dox1 through Doxm is a scanning signal for successively driving the electron sources provided in the display panel, that is, for successively driving the electron-emitting device groups, arranged by matrix wiring in a matrix with m rows and n columns, one column (n devices) at one time.

Applied to the terminals Doy1 through Doyn is a modulation signal for controlling the output electron beam of each of one row of electron-emitting devices selected by the above scanning signal. A DC voltage, for example, of 10 kV is supplied to the high-voltage terminal Hv from the DC voltage source Va. This is an acceleration voltage for imparting sufficient energy for exciting the phosphor to the electron beam emitted from the electron-emitting device.

The scanning circuit 102 will be described. This circuit contains m switching devices (schematically indicated at S1 through Sm in the drawing). The switching devices select either the output voltage of the DC voltage source Vx or 0V (ground level), and are electrically connected to the terminals Dox1 through Doxm of the display panel 101. The switching devices S1 through Sm operate in accordance with a control signal Tscan output from the control circuit 103, and can be formed, for example, through a combination of switching devices like FETs.

In this embodiment, the DC voltage source Vx outputs a fixed voltage on the basis of the characteristics of the electron-emitting devices (electron emission threshold voltage) such that the driving voltage applied to a device not being scanned is not higher than the electron emission threshold voltage.

The control circuit 103 serves to realize consistency in the operation of the components so that appropriate display may be effected based on an image signal input from outside. The control circuit 103 generates control signals Tscan, Tsft, and Tmry for each component on the basis of the synchronization signal Tsync supplied from the synchronization signal separation circuit 106.

The synchronization signal separation circuit 106 is a circuit for separating a synchronization signal component and a luminance signal component from an NTSC television signal input from outside. The synchronization signal obtained through separation by the synchronization signal separation circuit 106, which consists of a vertical synchronization signal and a horizontal synchronization signal, is shown in the drawing as Tsync for the sake of convenience. The image luminance signal component obtained through separation from the television signal is expressed as the DATA signal for the sake of convenience. The DATA signal is input to the shift register 104.

The shift register 104 serves to effect serial-parallel conversion for each line of the image on the DATA signal serially input in time sequence, and operates in accordance with the control signal Tsft supplied from the control circuit 103 (That is, the control signal Tsft may be regarded as a shift lock of the shift register 104). The one-image-line data serial/parallel-converted (which corresponds to driving data for n electron-emitting devices) is output from the shift register 104 as n parallel signals of 1d1 through 1dn.

The line memory 105 is a device for storing one-image-line data for a period of time required, and appropriately stores the contents of 1d1 through 1dn in accordance with the control signal Tmry supplied from the control circuit 103. The stored contents are output as 1d'1 through 1d'n and input to the modulation signal generator 107.

The modulation signal generator 107 is a signal source for appropriately driving and modulating the surface conduction electron-emitting devices in accordance with the image data 1d'l through 1d'n. The output signal thereof is applied to the surface conduction electron-emitting devices in the display panels 101 through the terminals Doy1 through Doyn.

The above-described surface conduction electron-emitting device has the following basic property with respect to the emission current Ie. In electron emission, there is a definite threshold value Vth, and electron emission occurs only when a voltage not lower than Vth is applied. For a voltage not lower than the electron emission threshold value, the emission current also varies in accordance with the variation in the voltage applied to the device. Thus, when applying a pulse-like voltage to the device, no electron emission occurs if, for example, a voltage lower than the electron emission threshold value is applied, whereas, when a voltage not lower than the electron emission threshold value is applied, an electron beam is output. In the process, by varying the pulse crest value Vm, it is possible to control the intensity of the output electron beam. Further, by varying the pulse width Pw, it is possible to control the charge amount of the electron beam output. Thus, as the system for modulating the electron-emitting device, it is possible to adopt a voltage modulation system, a pulse width modulation system, etc. When executing the voltage modulation system, it is possible to use as the modulation signal generator 107 a voltage modulation type circuit which generates a voltage pulse of a fixed length and appropriately modulates the crest value of the pulse in accordance with the input data.

When executing the pulse width modulation system, it is possible to use as the modulation signal generator 107 a pulse width modulation type circuit which generates a voltage pulse of a fixed crest value and appropriately modulates the width of the voltage pulse in accordance with the input data.

The shift register 104 and the line memory 105 may be of digital signal type or analog signal type since it is only necessary that the serial/parallel change and storage of the image signal should be effected at a predetermined speed.

When digital signal type devices are used, it is necessary to digitize the output signal DATA of the synchronization signal separation circuit 106. For this purpose, an A/D converter is provided at the output portion of the synchronization signal separation circuit 106. It is to be noted in this regard that the circuit used for the modulation signal generator 107 somewhat differs according to whether the output signal of the line memory 105 is a digital signal or an analog signal. That is, in the case of the voltage modulation system using a digital signal, a D/A converter or the like is used for the modulation signal generator 107, and an amplification circuit or the like is added as needed. In the case of the pulse width modulation system, the circuit used for the modulation signal generator 107 is one which is a combination, for example, of a high-speed oscillator, a counter for counting the number of waves output by the oscillator, and a comparator for comparing the output value of the counter with the output value of the memory. It is possible, as needed, to add an amplifier for amplifying the pulse-width-modulated modulation signal output by the comparator to the driving voltage of the surface conduction electron-emitting device.

In the case of the voltage modulation system using an analog signal, it is possible to adopt an amplification circuit using, for example, an operation amplifier, for the modulation signal generator 107, and to add a level shift circuit or the like as needed. In the case of the pulse width modulation system, it is possible to adopt, for example, a voltage control type oscillation circuit (VOC), and to add, as needed, an amplifier for effecting voltage amplification to the driving voltage for the surface conduction electron-emitting device.

In an image display apparatus to which the present invention as described above is applicable, voltage is applied to the electron-emitting devices through the external terminals Dox1 through Doxm and Doy1 through Doyn, whereby electron emission occurs. By applying a high voltage to the metal back 85 or a transparent electrode (not shown) through the high-voltage terminal Hv, the electron beam is accelerated. The accelerated electrons collide with the fluorescent layer 84 to cause light emission, thereby forming an image.

Next, as still another embodiment of the electron source formed by using the above-described electron source forming substrate, an electron source in which a plurality of electron-emitting devices are arranged in a ladder-like fashion on the electron source forming substrate of FIGS. 1A and 1B, and an image-forming apparatus using such an electron source will be described with reference to FIGS. 13 and 14.

Figure 13:
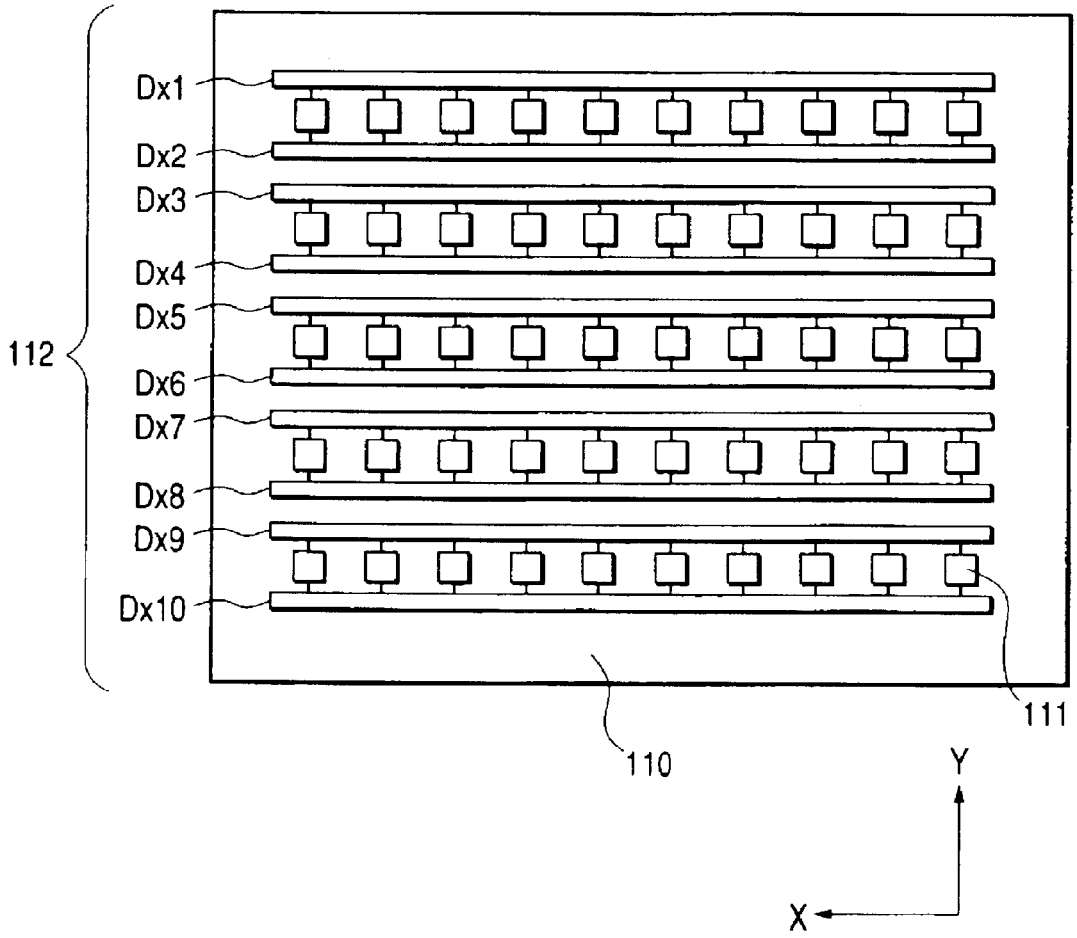
FIG. 13 is a schematic diagram showing another construction example of the electron source of the present invention.

FIG. 13 is a schematic diagram showing an example of the electron source of a ladder-like arrangement. In FIG. 13, numeral 110 indicates a substrate on which the above-described first and second layers are formed beforehand, and numeral 111 indicates surface conduction electron-emitting devices. Numeral 112 (Dx1 through Dx10) indicates a common wiring for connecting the surface conduction electron-emitting devices 111.

A plurality of surface conduction electron-emitting devices 111 are arranged in parallel in the X-direction on the substrate 110 (This will be referred to as the "device row"). A plurality of such device rows are arranged to form an electron source. By applying a driving voltage between the common wirings of the device rows, it is possible to independently drive the each of the device rows. That is, a voltage not lower than the electron emission threshold value is applied to a device row from which an electron beam is to be emitted, and a voltage lower than the electron emission threshold value is applied to a device row from which no electron beam is to be emitted. Regarding the common wirings Dx2 through Dx9 between the device rows, it is possible to form, for example, the wirings Dx2 and Dx3 as the same wiring.

Figure 14:
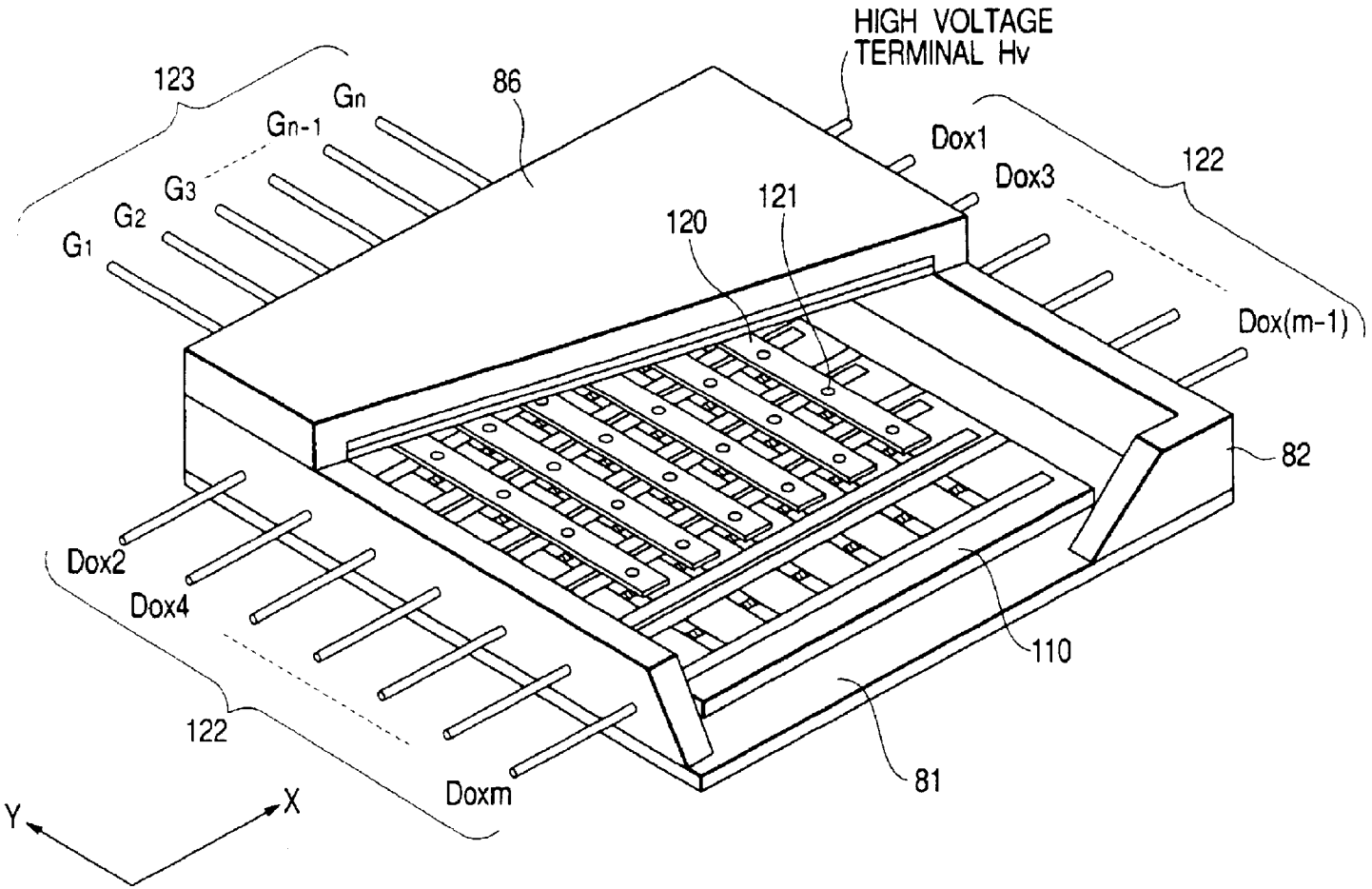
FIG. 14 is a schematic diagram showing another construction example of the image-forming apparatus of the present invention.

FIG. 14 is a schematic diagram showing an example of the panel structure of an image-forming apparatus provided with a ladder-arrangement electron source. Numeral 120 indicates grid electrodes, numeral 121 indicates openings allowing passage of electrons, and numeral 122 indicates external terminals consisting of terminals Dox1, Dox2, . . . , Doxm. Numeral 123 indicates external terminals connected to the grid electrode 120 and consisting of terminals G1, G2, . . . , Gn, and numeral 110 indicates an electron source substrate in which the common wirings between the device rows are formed as the same wiring.

In FIG. 14, the components which are the same as those of FIGS. 8 and 13 are indicated by the same reference numerals. This apparatus markedly differs from the image-forming apparatus of the passive-matrix arrangement shown in FIG. 8 in that the grid electrodes 120 are provided between the electron source substrate 110 and the face plate 86.

The grid electrodes 120 serve to modulate the electron beams emitted from the electron-emitting devices. To allow passage of electron beams through stripe-like electrodes perpendicular to the device rows in ladder-like arrangement, there is provided one circular opening 121 for each device. As the openings 121, it is possible to provide a large number of passage openings, for example, in a mesh-like fashion. It is also possible to provide the grids around or in the vicinity of the electron-emitting devices.

The external terminals 122 and the grid external terminals 123 are electrically connected to a control circuit (not shown).

In the image-forming apparatus of this embodiment, modulation signals corresponding to one line of the image are simultaneously applied to the grid electrode rows in synchronism with successive driving (scanning) of the device rows. This makes it possible to control the application of each electron beam to the phosphor and display the image line by line.

The two types of construction of the image-forming apparatus described above are only given by way of example, and various modifications are possible without departing from the gist of the present invention. While an NTSC-type input signal is used in the above embodiment, this should not be construed restrictively. It is also possible to use PAL-type and SECAM-type input signals. Further, it is also possible to adopt a TV (for example, high-quality TV) signal consisting of a large number of scanning lines.

The image-forming apparatus of the present invention is applicable to a display apparatus for television broadcasting, a display apparatus for a television conference system, a display apparatus of a computer or the like, an optical printer formed by using a photosensitive drum, etc.

EXAMPLES

The present invention will now be described in detail with reference to specific examples, which should not be construed restrictively. The present invention covers replacement of the components and changes in design effected without departing from the technical scope for achieving the object of the present invention.

Example 1

The electron source shown in FIGS. 2A and 2B was prepared by the manufacturing process shown in FIGS. 5A through 5D.

(1) First, the electron source forming substrate shown in FIGS. 1A and 1B was prepared (FIG. 5A). A high strain point glass (containing 58% of $SiO_2$, 4% of $Na_2O$, and 7% of $K_2O$) was washed well, and a mixture solution of fine particles of $SiO_2$ and an organic silicon compound was prepared. In the mixture solution, $SiO_2$ particles doped with phosphorus for resistance adjustment and having an average size of 20 nm and 5% of $SiO_2$ particles whose particle size was 60 nm were dispersed/mixed. The mixture solution was applied to the glass substrate by using a device called a slit coater, and dried at 80 to 100° C. for 3 minutes by using a hot plate. Further, a solution containing only an organic silicon compound was applied by using a slit coater, and dried at 80° C. for 3 minutes by using a hot plate. Thereafter, baking was performed in an oven at 500° C. for 60 minutes. As a result, there were formed on the high strain point glass substrate a first layer containing $SiO_2$ fine particles doped with phosphorus for resistance adjustment and larger $SiO_2$ particles in a ratio by weight of 80:20 and having a thickness of 300 nm, and a second layer consisting of $SiO_2$ and having a thickness of 80 nm as the upper layer. After baking, this film partially exhibited voids, which were filled with $SiO_2$. In this film, the particles having the size of 60 nm were appropriately dispersed, and allowed to protrude from the surface in a proportion of one particle for every 10 $\mu$ml by 5 to 10 nm on the average. The surfaces of the protruding particles were covered with $SiO_2$ to a thickness of several nm. However, there was no problem in terms of eliminating electron charge-up.

Figure 5B:
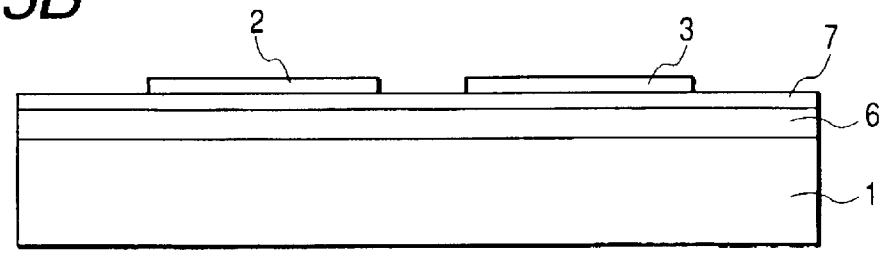
Figure 5C:
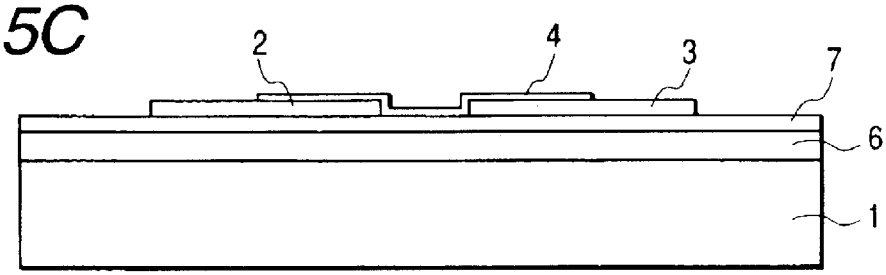

(2) Next, device electrodes 2 and 3 were formed on the electron source forming substrate (FIG. 5B).

First, a photo-resist layer was formed on the above-described substrate, and openings corresponding to the configuration of the device electrodes were formed on the photo-resist layer by photolithography. The formation of a Ti film 5 nm thick and a Pt film 100 nm thick was effected thereon by sputtering, and the photo-resist layer was melted and removed by organic solvent to form the device electrodes 2 and 3 by liftoff. At this time, the distance between the device electrodes was 20 $\mu$m, and the electrode length was 600 $\mu$m.

(3) Subsequently, an electroconductive film 4 was formed between the pair of device electrodes 2 and 3 (FIG. 5C). First, a solution containing organic palladium was applied by a bubble-jet-type ink-jet spraying device so as to be in a width of 90 $\mu$m. Thereafter, heating was performed at 350° C. for 30 minutes to obtain an electroconductive film 4 consisting of fine particles of palladium oxide.

Then, using a paste material containing silver as metal component (NP-4736S, manufactured by Noritake Kabushiki-Kaisha), printing was performed by screen printing, and drying was effected at 110° C. for 20 minutes. Subsequently, the paste material was baked by a heat-treatment device under the conditions of a peak temperature of 495° C. and a peak maintaining time of 10 minutes to form a lower wiring 10 having a thickness of 7 $\mu$m.

Next, an inter-layer insulating layer 12 was formed. By heat treatment under the same conditions as the above paste baking, an insulating paste (NP4045, manufactured by Noritake) was laminated four times to attain the requisite film thickness to thereby secure the function of the inter-layer insulating layer.

Thereafter, an upper wiring 11 was formed using the same material as that for the lower wiring 10.

Forming and activation were performed on the electron source thus prepared (FIG. 5D).

Further, the electron source was prepared in the form of a panel as shown in FIG. 8, and driven. There was little charge-up at the time of driving, and the panel was used as a display without involving any particular problem.

Further, the portion of this electron source substrate containing the conductive layers 4 and the gap 5 was cut out, and analyzed by SIMS (Secondary Ion Mass Spectrometry) to check the Na diffusion state. The analysis showed that the concentration of the surface Na in the central portion between the device electrodes was $1\times10^{19}$ atom/cm$^3$. This means that the sodium concentration has been reduced to 1/100 as compared with the sodium concentration of the high strain point glass, which is $1\times10^{21}$ atom/cm$^3$, thus indicating a marked sodium blocking effect.

Example 2

As in Example 1, a high strain point glass (containing 58% of $SiO_2$, 4% of $Na_2O$, and 7% of $K_2O$) was washed well, and a mixture solution of fine particles of $SiO_2$ and an organic silicon compound was prepared. In the mixture, $SiO_2$ particles doped with phosphorus for resistance adjustment and having an average size of 20 nm and 5% of cohering $SiO_2$ particles whose size was 60 nm were dispersed/mixed. The mixture solution was applied to the glass by using a device called a slit coater to prepare an electron source forming substrate.

The electron source substrate formed in the same manner as in Example 1 except for the above was prepared in the form of a panel and driven. The result showed that there was no charge-up, involving no problem in the use of the panel as a display.

Comparative Example

An electron source was prepared in completely the same manner as in Example 1 except that an $SiO_2$ layer was formed on the substrate to a thickness of 100 nm by sputtering to be used as an electron source forming substrate. The substrate was used in the form of a panel and driven.

The portion of this electron source substrate containing the conductive layers 4 and the gap 5 was cut out and analyzed by SIMS to check it for the Na diffusion state. The result showed that the surface sodium concentration in the central portion between the device electrodes was $5\times10^{20}$ atom/cm$^3$.

As can be seen from the result, the electron source forming substrate of the present invention also provides an Na diffusion restraining effect.

As described above, the present invention provides the following advantage.

The present invention provides an electron source forming substrate, an electron source, and an image-display apparatus in which the variation with the passage of time in the electron emission property of the electron-emitting device due to Na diffusion is reduced and which involve little charge-up after driving.

What is claimed is:

1. An electron source comprising:

a substrate;

an insulating material layer provided on the substrate, wherein the insulating material layer has a plurality of partially exposed metal oxide particles on its surface and a plurality of enclosed metal oxide particles; and an electron-emitting material and an electrode connected with said electron-emitting material, wherein said electron-emitting material and said electrode are disposed on said insulating material layer, and an average particle size of said partially exposed metal oxide particles is different from an average particle size of said enclosed metal oxide particles.

2. The electron source according to claim 2, wherein the plurality of enclosed metal oxide particles form a metal oxide particle layer in the insulating material layer.

3. The electron source according to claim 2, wherein the plurality of enclosed metal oxide particles and the plurality of partially exposed metal oxide particles form a metal oxide particle layer in the insulating material layer.

4. The electron source according to claim 2, wherein the average particle size of the plurality of metal oxide particles partially exposed on the surface of the insulating material layer is larger than the average particle size of the plurality of metal oxide particles enclosed in the insulating material layer.

5. The electron source according to claim 2, through wherein the average particle size of the plurality of metal oxide particles partially exposed on the surface of the insulating material layer is in the range of 50 nm to 70 nm, and wherein the average particle size of the plurality of metal oxide particles enclosed in the insulating material layer is in the range of 6 nm to 40 nm.

6. The electron source according to claim 2, wherein the average particle size of the plurality of metal oxide particles partially exposed on the surface of the insulating material layer is 60 nm, and wherein the average particle size of the plurality of metal oxide particles enclosed in the insulating material layer is in the range of 6 nm to 40 nm.

7. The electron source according to claim 2, wherein the substrate is one containing sodium.

8. The electron source according claim 2, wherein the insulating material layer is a sodium blocking layer.

9. The electron source according to claim 2, wherein the insulating material layer is an antistatic layer.

10. The electron source according to claim 2, wherein the metal oxide particles are electron conductive oxide particles.

11. The electron source according to claim 2, wherein the metal oxide particles are particles of an oxide of a metal selected from the following metals: Fe, Ni, Cu, Pd, Ir, In, Sn, Sb, and Re.

12. An image display apparatus comprising an envelope, an electron source according to claim 2, and an image display member adapted to display images through application of electrons from the electron source, arranged in the envelope.

13. A substrate structure which is a precursor to an electron source, and on which an electron-emitting device of the electron source is to be disposed, the substrate structure comprising:

a substrate; and an insulating material layer provided on the substrate, wherein the insulating material layer has a plurality of partially exposed metal oxide particles on its surface and a plurality of enclosed metal oxide particles, wherein an average particle size of the plurality of metal oxide particles partially exposed on the surface of the insulating material layer is larger than an average particle size of the plurality of metal oxide particles enclosed in the insulating material layer.

14. A substrate structure which is a precursor to an electron source, and on which an electron-emitting device of the electron source is to be disposed, the substrate structure comprising;

a substrate; and an insulating material layer provided on the substrate, wherein the insulating material layer has a plurality of partially exposed metal oxide particles on its surface and a plurality of enclosed metal oxide particles, wherein an average particle size of the plurality of metal oxide particles partially exposed on the surface of the insulating material layer is in a range of 50 nm to 70 nm, and wherein an average particle size of the plurality of metal oxide particles enclosed in the insulating material layer is in a range of 6 nm to 40 nm.

15. A substrate structure which is a precursor to an electron source, and on which an electron emitting device of the electron source is to be disposed, the substrate structure comprising:

a substrate; and an insulating material layer provided on the substrate, wherein the insulating material layer has a plurality of partially exposed metal oxide particles on its surface and a plurality of enclosed metal oxide particles, wherein an average particle size of the plurality of metal oxide particles partially exposed on the surface of the insulating metal layer is 60 nm, and wherein an average particle size of the plurality of metal oxide particles enclosed in the insulating material layer is in a range of 6 nm to 40 nm.

16. The electron source according to any one of claims 2, 13, 14 or 15, wherein said insulating material layer contains $SiO_2$ as a main ingredient.

17. The electron source according to any one of claims 13, 14 or 15, wherein the plurality of enclosed metal oxide particles form a metal oxide particle layer in the insulating material layer.

18. The electron source according to any one of claims 13, 14, or 15, wherein the plurality of enclosed metal oxide particles and the plurality of partially exposed metal oxide particles form a metal oxide particle layer in the insulating material layer.

* * * * *

UNITED STATES PATENT AND TRADEMARK OFFICE

CERTIFICATE OF CORRECTION

PATENT NO. : 6,803,707 B2
DATED : October 12, 2004
INVENTOR(S) : Kazuya Ishiwata et al.

It is certified that error appears in the above-identified patent and that said Letters Patent is hereby corrected as shown below:

Title page, Item [54] and Column 1, lines 1-3,
Title, "ELECTRON SOURCE HAVING AN INSULATING LAYER WITH METAL OXIDE PARTICLES" should read -- A SUBSTRATE STRUCTURE WHICH IS A PRECURSOR TO AN ELECTRON SOURCE AND HAVING A SUBSTRATE AND AN INSULATING MATERIAL LAYER WITH METAL OXIDE PARTICLES --.

Column 1,
Line 21, "Advance" should read -- Advances --.
Line 26, "Reico" should read -- Radio --.
Line 33, "$SnO_2$thin" should read -- $SnO_2$ thin --.

Column 11,
Line 15, "CnH2n=2" should read -- CnH2n+2 --.

Column 13,
Line 52, "are used" should read -- is used --.
Line 57, "ample" should read -- ampule --.

Column 20,
Line 55, 58 and 62, "claim 2" should read -- claim 1 --.

Column 21,
Line 1, "claim 2, through" should read -- claim 1, --.
Lines 8, 14, 16, 18, 22 and 27, "claim 2" should read -- claim 1 --.

UNITED STATES PATENT AND TRADEMARK OFFICE

CERTIFICATE OF CORRECTION

PATENT NO. : 6,803,707 B2
DATED : October 12, 2004
INVENTOR(S) : Kazuya Ishiwata et al.

It is certified that error appears in the above-identified patent and that said Letters Patent is hereby corrected as shown below:

Column 22,
Line 4, “comprising;” should read -- comprising: --.
Line 31, “claims 2,” should read -- claims 1, --.

Signed and Sealed this

Sixth Day of September, 2005

JON W. DUDAS
*Director of the United States Patent and Trademark Office*

UNITED STATES PATENT AND TRADEMARK OFFICE

CERTIFICATE OF CORRECTION

PATENT NO. : 6,803,707 B2
DATED : October 12, 2004
INVENTOR(S) : Ishiwata et al.

It is certified that error appears in the above-identified patent and that said Letters Patent is hereby corrected as shown below:

Column 21,
Line 20, "claim 2" should read -- claim 1 --.

Signed and Sealed this

Twenty-fifth Day of April, 2006

JON W. DUDAS
*Director of the United States Patent and Trademark Office*